US012337440B2

(12) United States Patent
Goeke et al.

(10) Patent No.: US 12,337,440 B2
(45) Date of Patent: Jun. 24, 2025

(54) METHOD AND DEVICE FOR PROCESSING A HARD-COATED WORKPIECE SURFACE OF A ROTATIONALLY SYMMETRICAL WORKPIECE

(71) Applicant: Thielenhaus Technologies GmbH, Wuppertal (DE)

(72) Inventors: Sebastian Goeke, Dortmund (DE); Sebastian Schumann, Dortmund (DE); Martin Lupp, Essen (DE); Thomas Schmitz, Wermelskirchen (DE)

(73) Assignee: Thielenhaus Technologies GmbH, Wuppertal (DE)

( * ) Notice: Subject to any disclaimer, the term of this patent is extended or adjusted under 35 U.S.C. 154(b) by 338 days.

(21) Appl. No.: 17/944,126

(22) Filed: Sep. 13, 2022

(65) Prior Publication Data

US 2023/0083679 A1 Mar. 16, 2023

(30) Foreign Application Priority Data

Sep. 14, 2021 (EP) ..... 21196493

(51) Int. Cl.
*B24B 5/01* (2006.01)
*B24B 27/00* (2006.01)

(52) U.S. Cl.
CPC ..... *B24B 5/01* (2013.01); *B24B 27/0076* (2013.01)

(58) Field of Classification Search
CPC .... B24B 5/00; B24B 5/01; B24B 5/12; B24B 7/17; B24B 27/0076; B24B 27/0084
See application file for complete search history.

(56) References Cited

U.S. PATENT DOCUMENTS 3,823,627 A * 7/1974 Scharfen ..... B23B 3/22 82/138
4,361,988 A 12/1982 Gramlich
(Continued)

FOREIGN PATENT DOCUMENTS

DE 4039805 A1 6/1992
DE 102010026026 A1 1/2012
(Continued)

OTHER PUBLICATIONS

Office Action for European Application No. 21196493.7, dated Sep. 19, 2024, 6 pages.

*Primary Examiner* — C. A. Rivera
(74) *Attorney, Agent, or Firm* — Calfee, Halter & Griswold LLP

(57) ABSTRACT

The present invention relates to a method and a device for processing a hard-coated workpiece surface of a rotationally symmetrical workpiece (1) with at least one grinding wheel, wherein the method comprises the following steps:

Figure 1:
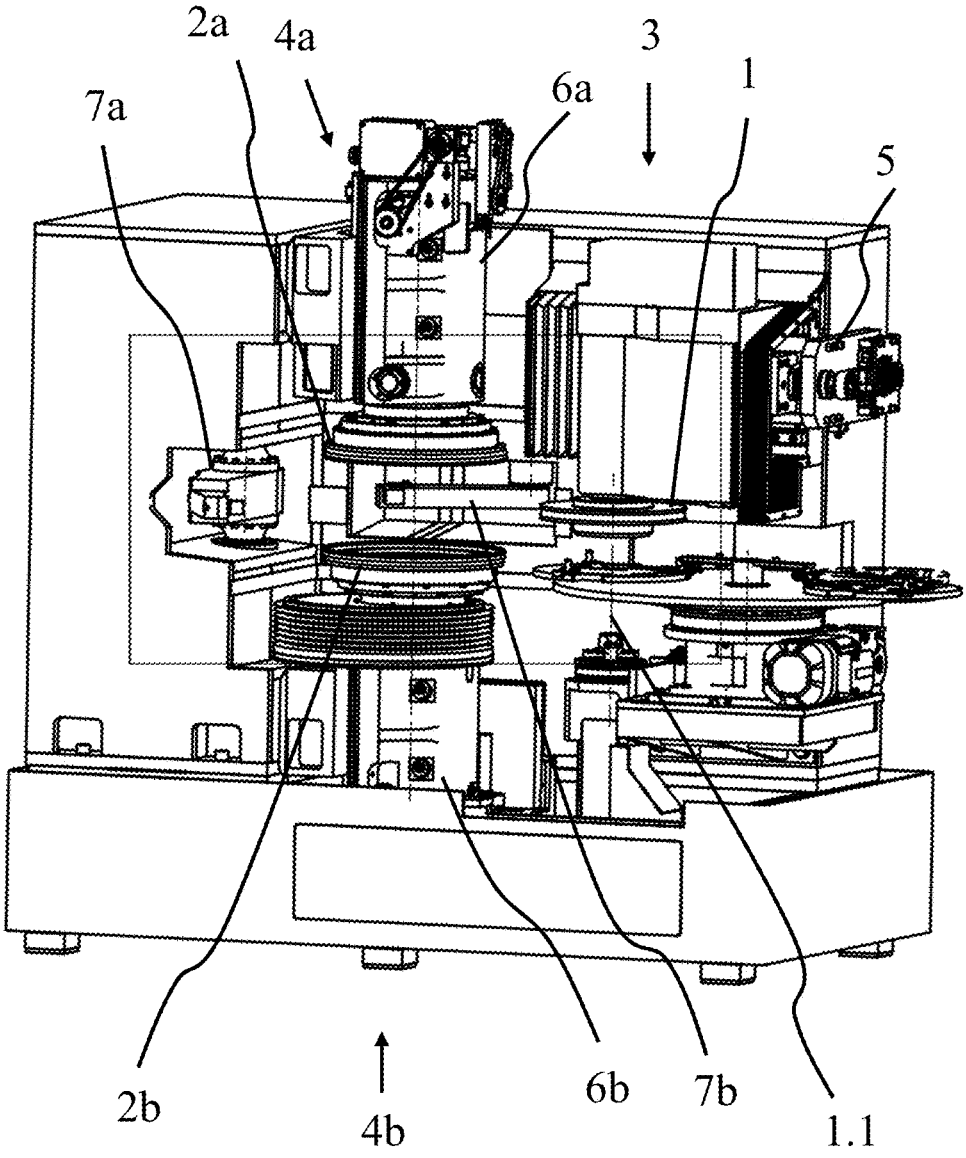

driving the workpiece (1) into a rotational motion around a workpiece axis of rotation (1.1), driving a grinding wheel (2*a*) into a rotational motion around a grinding wheel axis of rotation (2*a*.1), angulating the grinding wheel axis of rotation (2*a*.1) and the workpiece axis of rotation (1.1) to each other so that the grinding wheel axis of rotation (2*a*.1) and the workpiece axis of rotation (1.1) are not parallel, processing the workpiece surface with the grinding wheel (2*a*), wherein the grinding wheel (2*a*) is in contact with the workpiece surface.

14 Claims, 5 Drawing Sheets

(56) References Cited

U.S. PATENT DOCUMENTS

| | | | | |
|---|---|---|---|---|
| 5,484,327 | A * | 1/1996 | Kovach | B24B 5/38 451/190 |
| 7,147,547 | B2 | 12/2006 | Junker | |
| 2012/0003904 | A1 * | 1/2012 | Schmitz | B24B 1/00 451/63 |

FOREIGN PATENT DOCUMENTS

| | | | |
|---|---|---|---|
| DE | 102019128522 | A1 | 4/2021 |
| EP | 1884314 | A1 | 2/2008 |
| EP | 3151999 | B1 | 7/2019 |
| WO | 8800513 | A1 | 1/1988 |

* cited by examiner

METHOD AND DEVICE FOR PROCESSING A HARD-COATED WORKPIECE SURFACE OF A ROTATIONALLY SYMMETRICAL WORKPIECE

The present invention relates to a method and a device for processing a hard-coated, in particular planar workpiece surface of a rotationally symmetrical, in particular disk-shaped workpiece with at least one grinding wheel. The invention relates in particular to the processing of a hard-coated brake disk.

Known for processing conventional brake disks are methods and devices, in which the brake disk is driven into a rotational motion around a workpiece axis of rotation, and the grinding wheel is driven into a rotational motion around the grinding wheel axis of rotation, wherein the workpiece axis of rotation and the grinding wheel axis of rotation are aligned parallel to each other, so that the workpiece surface of the brake disk to be processed and the processing surface of the grinding wheel are also aligned parallel to each other. During the processing operation, the grinding wheel and brake disk thus abut against each other over a large area.

In the brake disks commonly in use today, during braking the ablation of the brake disk and of the brake pad generates fine dust, which contaminates the outside air, but can also become deposited on rims as dirt. In addition, oxidation of the brake disk can negatively influence the first braking operation after a prolonged period of nonuse. Therefore, it has already been proposed that the surfaces of brake disks be provided with hard particles, so that the brake disks become more corrosion-resistant. For example, tungsten carbide particles are applied to the brake disks by laser sintering. However, the surfaces of the hard-coated brake disks must still be processed to achieve the required surface properties (for example, dimensional and shape accuracy and roughness). However, as the result of the hard coating advantageous for reducing the fine dust load, the hard-coated brake disks cannot be adequately processed with conventional methods and machines, since large forces are required to process the surfaces of the hard-coated brake disks.

Therefore, the object of the present invention is to indicate a method and a device with which a hard-coated brake disk can be efficiently processed.

The object is achieved by a method and a device with the features of the respective independent claim. Advantageous further developments of the method and the device are indicated in the dependent claims, wherein individual features of the advantageous further developments can be combined with each other in a technically reasonable manner. In particular, the features and advantages disclosed with reference to the method can be applied to the device and vice versa.

In particular, the object is achieved by a method for processing a hard-coated and in particular planar workpiece surface of a rotationally symmetrical workpiece with at least one grinding wheel, comprising at least the following steps:

- Driving the workpiece into a rotational motion around a workpiece axis of rotation,
- Driving a grinding wheel into a rotational motion around a grinding wheel axis of rotation,
- Angulating the grinding wheel axis of rotation and the workpiece axis of rotation to each other so that the grinding wheel axis of rotation and the workpiece axis of rotation are not parallel, and
- Processing the workpiece surface with the grinding wheel, wherein the grinding wheel is in contact with the workpiece surface.

The object is also achieved by a device for processing a hard-coated and in particular planar workpiece surface of a rotationally symmetrical surface, comprising:

- A workpiece driving device for generating a rotational motion around a workpiece axis of rotation,
- At least one grinding wheel driving device for generating a rotational motion around a grinding wheel axis of rotation,
- At least one infeed device for bringing the grinding wheel into contact with the workpiece surface, and
- At least one angulating device for angulating the grinding wheel axis of rotation and the workpiece axis of rotation to each other, so that the grinding wheel axis of rotation and the workpiece axis of rotation are not parallel.

In other words: The basic idea of the invention provides that the grinding wheel be angulated to the workpiece during the processing operation (i.e., while the grinding wheel is in contact with the workpiece and both are rotationally driven). Accordingly, the grinding wheel axis of rotation and workpiece axis of rotation are not parallel during this processing operation. In the case of a planar workpiece surface, the workpiece surface is thus also not parallel to the planar processing surface of the grinding wheel. As a result of such an angulation, the grinding wheel is in contact with the workpiece surface during the processing operation with a smaller surface (preferably in a quasi-linear or even just quasi-punctiform manner). As a consequence, given an identical application of force, the pressure between the workpiece surface and the grinding wheel can be increased, thereby resulting in an improved ablation of the hard-coated workpiece surface. For example, the angulated grinding wheel can thus be in contact with the workpiece surface to be processed only at one punctiform or linear location during its initial use, while the shape of the contact location can vary as processing continues due to the wearing of the grinding wheel.

In principle, it would be sufficient to provide exactly one grinding wheel driving device for each workpiece driving device, so that exactly one side of the workpiece can be processed with the one grinding wheel. The other side of the workpiece could then potentially be processed in a later processing step with the same grinding wheel. However, it is preferred that the device for the one (or each) workpiece driving device have a second grinding wheel driving device for generating a rotational motion around a second grinding wheel axis of rotation, which is arranged in particular in such a way that a second, in particular planar workpiece surface of the rotationally symmetrical workpiece lying opposite the first workpiece surface can be processed with a second grinding wheel that rotates around the second grinding wheel axis of rotation. The two grinding wheels preferably have opposite rotational directions. In particular a second angulating device for angulating the second grinding wheel axis of rotation to the workpiece axis of rotation is provided for the second grinding wheel driving device, so that the second grinding wheel axis of rotation and the workpiece axis of rotation are not parallel while processing the second workpiece surface. The second workpiece surface can be processed simultaneously with the first workpiece surface with a second grinding wheel driving device and a second angulating device, wherein the angulation of the second grinding wheel to the workpiece axis of rotation also enables a higher ablation on the second workpiece surface.

In this conjunction, it is provided in particular that the second grinding wheel driving device be operated synchronously (inversely) to the first grinding wheel driving device. Therefore, the amount of the (first) angle of incidence between the (first) grinding wheel axis of rotation and the workpiece axis of rotation is equal to the amount of the (second) angle of incidence between the second grinding wheel axis of rotation and the workpiece axis of rotation during the processing operation. As a consequence, for example, both sides of a brake disk can be processed simultaneously and identically. The device is preferably set up in such a way that the two grinding wheel driving devices can be swiveled independently of each other but in opposite directions relative to a machine frame during the processing operation.

In particular during the implementation of only exactly one grinding wheel driving device, it may be enough for angulating the grinding wheel axis of rotation and the workpiece axis of rotation relative to each other to have exactly one angulating device, with which either the grinding wheel driving device is angulated to the workpiece driving device, or with which the workpiece driving device is angulated to the grinding wheel driving device. In the advantageous configuration of two grinding wheel driving devices, it is preferred that each grinding wheel driving device have allocated to it an angulating device, so that the two grinding wheel driving devices can be angulated relative to the workpiece driving device.

In particular, a grinding wheel can be angulated to the workpiece by means of a swiveling motion by exactly one rotational degree of freedom. In this case, then, the corresponding angulating device has exactly one rotational degree of freedom. However, it can also be provided that the angulation allow a swiveling motion around two or more rotational degrees of freedom. Accordingly, the or each angulating device has two rotational degrees of freedom, or the workpiece axis/axes of rotation or the grinding wheel axis of rotation can be swiveled around two rotational degrees of freedom.

For example, the at least one angulating device can have one or several (swiveling) axis/axes, spherical surface(s), calotte surface(s) or solid state joints for realizing the one degree of freedom or several degrees of freedom.

The angulating device preferably comprises a sleeve-shaped outer body, in which the workpiece driving device is mounted so that it can swivel around one or several rotational degrees of freedom. The sleeve-shaped outer contour can preferably be linearly fed in exactly one direction or in all three spatial directions. If the angulating device can only be linearly fed in one spatial direction, the workpiece driving device can preferably be linearly fed in one or several (two or three) spatial direction(s). In an embodiment, an angulating drive can be secured to the sleeve-shaped outer body for each rotational degree of freedom.

In order to bring the at least one grinding wheel into contact with the workpiece surface, at least one infeed device must be provided, with which the workpiece (or its workpiece driving device) and the grinding wheel (or its grinding wheel driving device) can be fed in relative to each other. In principle, it would be sufficient to provide only one infeed device (for the workpiece driving device or the grinding wheel driving device), with which a relative motion can be performed parallel and/or orthogonally to the workpiece axis of rotation. However, it is preferred that at least one infeed device be provided, with which the workpiece (or the workpiece driving device) can be moved in a plane orthogonal to the workpiece axis of rotation (in particular radially to the workpiece axis of rotation) to the grinding wheel driving devices that are preferably allocated in particular to a respective angulating device. However, it can also be provided that each grinding wheel driving device have allocated to it an infeed device, with which the grinding wheel driving device can be moved in a plane orthogonally to the workpiece axis of rotation and/or axially.

An especially preferred embodiment provides that the grinding wheel and the workpiece be moved relative to each other in a plane perpendicular to the workpiece axis of rotation during the processing operation. Accordingly, at least one infeed device is set up in such a way that the grinding wheel(s) and the workpiece can be moved relative to each other during the processing operation in a plane perpendicular to the workpiece axis of rotation. Accordingly, then, the rotating grinding wheel (or the rotating grinding wheels) are moved on a path arranged in the plane perpendicular to the workpiece axis of rotation relative to the rotating workpiece (in particular in a radial direction linearly toward the workpiece axis of rotation or away from the latter). In this way, the entire workpiece surface of a side of the workpiece to be processed can be processed by means of the grinding wheel, and a desired crosscut can possibly be generated.

In this conjunction, it is provided in particular that the grinding wheel(s) be angulated to the workpiece preferably designed as a brake disk, while the grinding wheels are not (yet) in contact with the workpiece surface. For processing purposes, this is followed by a relative motion in a plane orthogonal to the workpiece axis of rotation, so that the grinding wheels process the workpiece surfaces of the brake disk from radially outside to radially inside (and thereafter possibly in the opposite direction). A high ablation can be achieved in this way.

It can also be provided that the (first) angle of incidence between the (first) grinding wheel axis of rotation and the workpiece axis of rotation and possibly also the (second) angle of incidence between the second grinding wheel axis of rotation and the workpiece axis of rotation be changed during the processing operation. Therefore, the angle of incidence is changed while the workpiece surface is in contact with the grinding wheel. As wear on the grinding wheel increases, the effective processing surface between the grinding wheel and workpiece surface increases with the grinding wheel angulated, so that changing the angle of incidence makes it possible to reduce the effective processing surface, as a result of which the pressure between the grinding wheel and workpiece surface is in turn increased. As a consequence, the ablation rate can be changed, adjusted, or corrected during the processing operation.

In another advantageous embodiment of the invention, which can also be regarded as an independent invention and thus be claimed without the angulation described above between the grinding wheel and workpiece, it is provided that the at least one grinding wheel be conditioned while being processed, i.e., dressed and/or sharpened, for example. Accordingly, the device comprises at least one conditioning device, which can be brought from an initial position into a conditioning position, so that the grinding wheel can be conditioned during the processing operation. The grinding wheel is thus conditioned while the grinding wheel itself is in contact with the workpiece. For example, the conditioning device can be brought into contact with the rotating grinding wheel during the processing operation at a location lying opposite the processing location of the grinding wheel with the workpiece. To this end, for example, the conditioning device being mounted so that it can swivel, and preferably move in an axial direction of the workpiece axis of rotation, can be brought by means of a suitable drive from the initial position into the position referred to as the conditioning position, in which the grinding wheel happens to also be in contact with the conditioning device.

It is additionally proposed that the workpiece surface be processed with the angulated grinding wheel(s) in a first processing step, while the workpiece axis of rotation and grinding wheel axis of rotation are aligned parallel to each other in a subsequent processing step, so that the grinding wheel(s) abut(s) against the (respective) workpiece surface with a relatively large surface area. A relatively high ablation of material from the hard-coated workpiece surface thus takes place in the first processing step with the angulated grinding wheel, while a higher surface quality (for example dimensional accuracy and/or required roughness) can be achieved in the subsequent processing step.

In particular, it is proposed that the following steps be performed in the specified sequence, which results in an especially short overall processing time:

i) Angulating the grinding wheel axes of rotation of two grinding wheels to the workpiece axis of rotation, wherein the workpiece axis of rotation cannot be swiveled, ii) Relatively moving the angulated grinding wheels in particular in a radial direction toward the workpiece axis of rotation during a first processing step, iii) Aligning the grinding wheel axes of rotation to the workpiece axis of rotation, so that the grinding wheel axes of rotation and the workpiece axis of rotation are parallel, in particular after the grinding wheels have been lifted from the workpiece, so that the grinding wheels are not in contact with the workpiece during the alignment, and iv) Processing the workpiece in a second processing step, during which the grinding wheel axes of rotation and the workpiece axis are parallel.

In order to correct an ablation of the workpiece surface (and/or the grinding wheel) that took place during the processing operation, the at least one grinding wheel and the workpiece can be fed to each other in particular parallel to the workpiece axis of rotation.

In particular, the device comprises a controller, which is set up to implement the described method.

Figure 2:
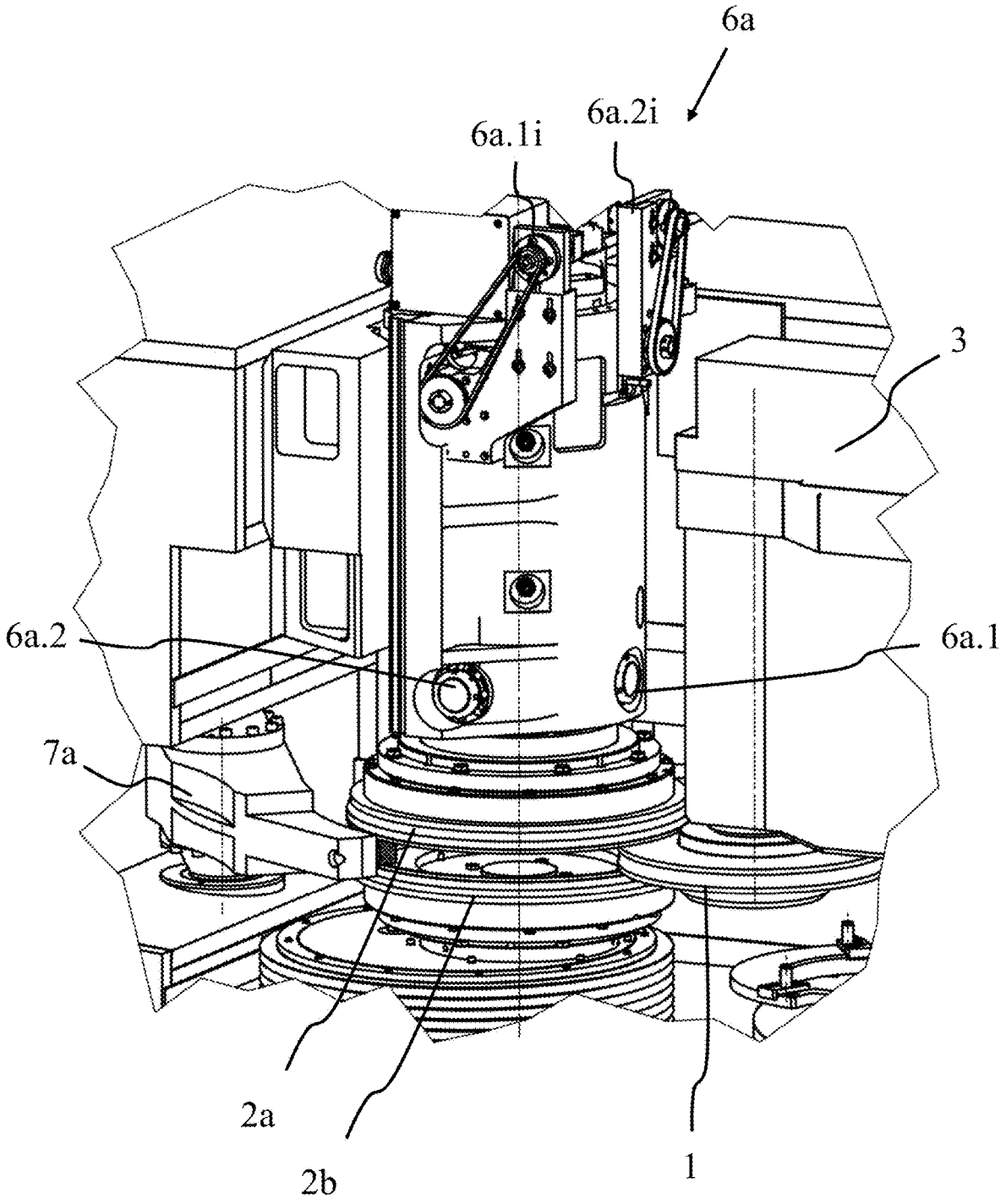
Figure 3:
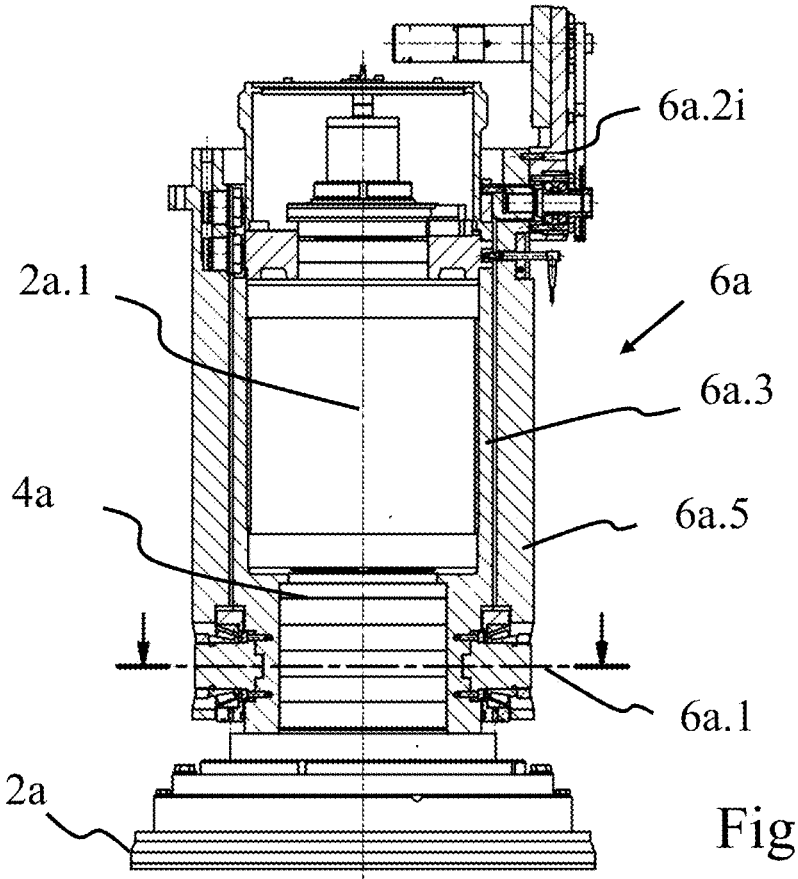
Figure 4:
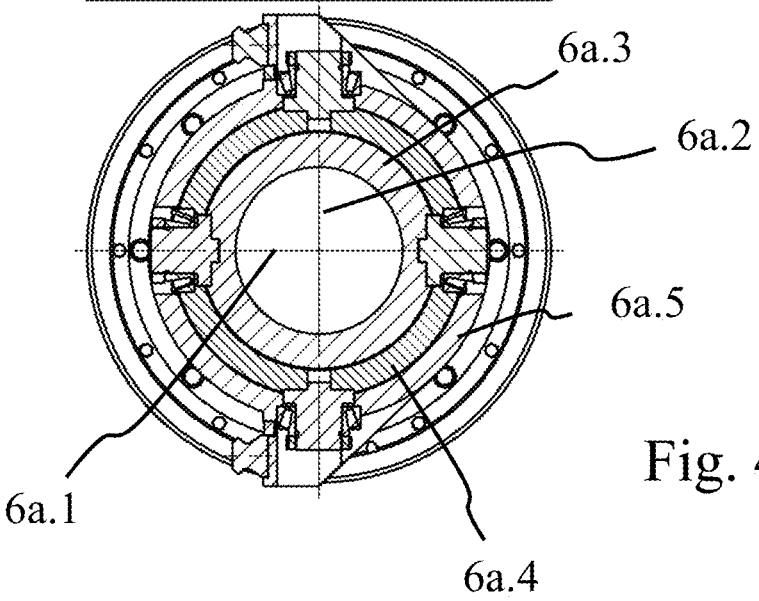
Figure 5:
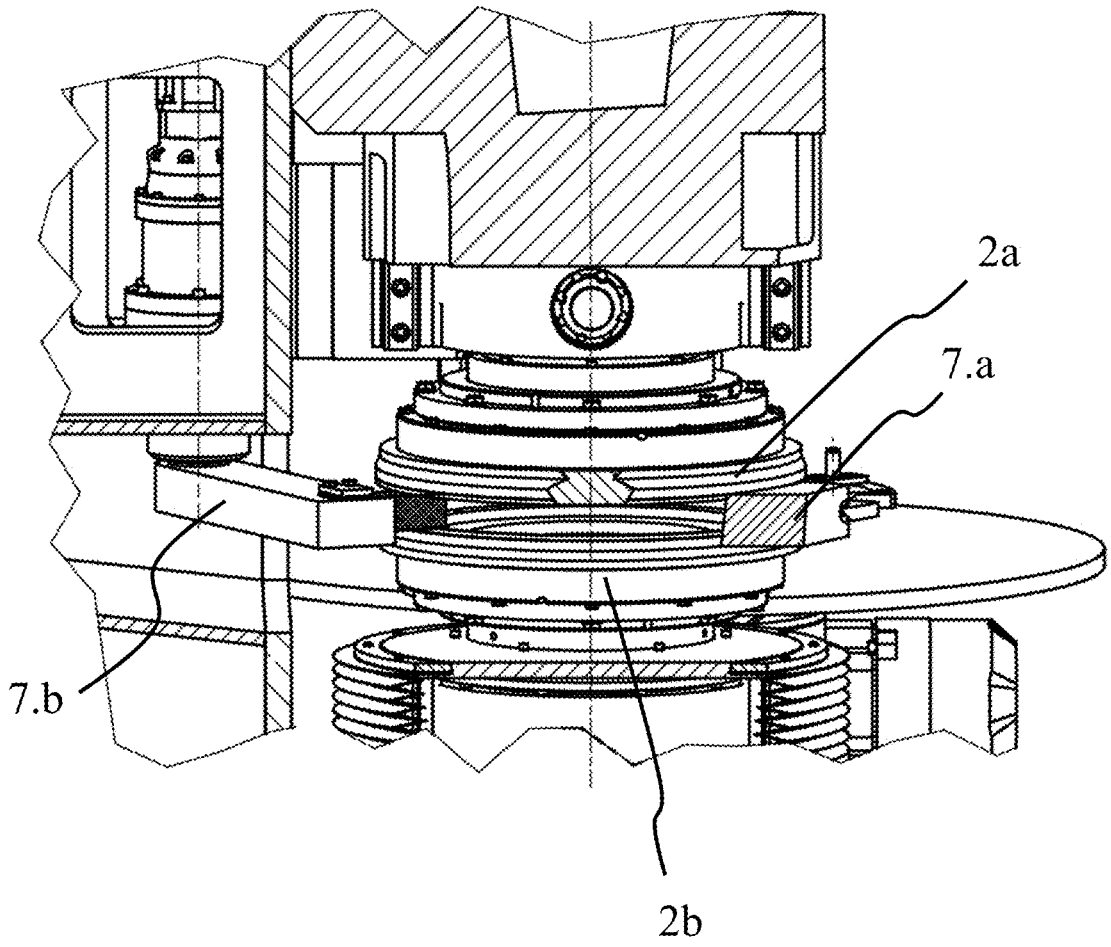
Figure 6:
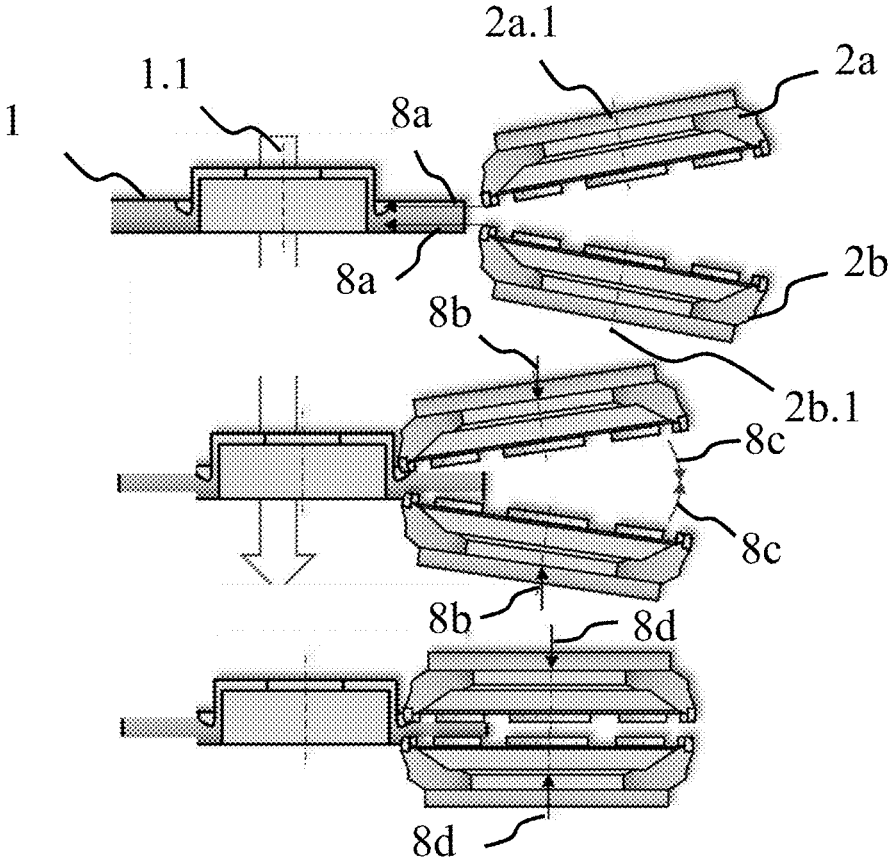

The invention along with the technical environment will be exemplarily explained below based on the figures, wherein the figures only show a preferred embodiment. Shown schematically on:

FIG. 1: is a device for processing a hard-coated brake disk,

FIG. 2: is a detailed view of the device with an angulating device for a grinding wheel, FIG. 3: is a sectional view through the angulating device, FIG. 4: is another sectional view through the angulating device, FIG. 5: is a detailed view of the device during the conditioning of the grinding wheel, and FIG. 6: is a schematic illustration of the procedure for processing the brake disk.

The device shown on FIG. 1 for processing a hard-coated workpiece 1 designed as a brake disk comprises a workpiece driving device 3, with which the brake disk 1 can be driven into a rotational motion around a workpiece axis of rotation 1.1. The device additionally comprises an infeed device 5, with which the brake disk 1 and the workpiece driving device 3 can be moved in a horizontal direction and in a vertical direction.

The device additionally comprises a first grinding wheel driving device 4*a*, which is mounted in a first angulating device 6*a*, and can be used to drive a first grinding wheel 2*a* into a rotational motion around a grinding wheel axis of rotation 2*a*.1. The device additionally has a second grinding wheel driving device 4*b*, which is mounted in a second angulating device 6*b*, and can be used to drive a second grinding wheel 2*b* into a rotational motion around a second grinding wheel axis of rotation 2*b*.1. The angulating devices 6*a*, 6*b* will still be explained in detail with reference to FIGS. 2 to 4.

The device additionally comprises a first conditioning device 7*a*, which can be brought into a conditioning position from an initial position, and used to dressed the grinding wheels 2*a*, 2*b*. The device additionally comprises a second conditioning device 7*b*, which likewise can be brought into a conditioning position from an initial position, and used to sharpen the grinding wheels 2*a*, 2*b*.

The first angulating device 6*a* and a first grinding wheel driving device 4*a* mounted therein will now be explained in more detail with reference to FIGS. 2 to 4, wherein reference is made to the fact that the second grinding wheel driving device 4*b* and the second angulating device 6*b* have an identical structural design. The first angulating device 6*a* comprises an inner bearing sleeve 6*a*.3, in which the driving device 4*a* for generating a rotational motion of the first grinding wheel 2*a* is arranged. The inner bearing sleeve 6*a*.3 is mounted in a second bearing sleeve 6*a*.4 so that it can swivel around a first swivel axis 6*a*.1, while the second bearing sleeve 6*a*.4 is mounted in an outer sleeve 6*a*.5 so that it can swivel around a second swivel axis 6*a*.2. The first grinding wheel driving device 4*a*, and hence also the first grinding wheel axis of rotation 2*a*.1, can thus be swiveled around two rotational degrees of freedom. Provided for this purpose is a first angulating device 6*a*.1*i*, with which the inner bearing sleeve 6*a*.3 can be swiveled around the first swivel axis 6*a*.1. Additionally provided is a second angulating drive 6*a*.2*i*, with which the second bearing sleeve can be swiveled around the second swivel axis 6*a*.2. However, the invention can also preferably only be realized with a swivel axis, and in particular with an accompanying angulating drive.

The first angulating device 6*a* and the second angulating device 6*b* can be fed in by undepicted drives in at least the horizontal direction.

In order to process the brake disk 1, both the brake disk 1 and the grinding wheels 2*a*, 2*b* are rotationally driven, wherein the grinding wheels 2*a*, 2*b* are each brought into contact with a side of the brake disk 1. It is now proposed that, while processing the brake disk 1, the grinding wheels 2*a*, 2*b* be angulated in opposite directions in such a way that the first grinding wheel axis of rotation 2*a*.1 and the second grinding wheel axis of rotation 2*b*.1 not be aligned parallel to the workpiece axis of rotation 1.1. Such a nonparallel angulation of the grinding wheels 2*a*, 2*b* can take place by means of the angulating devices 6*a*, 6*b*.

FIG. 6 shows an especially preferred procedure, to which the invention is not confined. The grinding wheels 2*a*, 2*b* are initially aligned with the angulating devices 6*a*, 6*b* in such a way that the first grinding wheel axis of rotation 2*a*.1 and the second grinding wheel axis of rotation 2*b*.1 are not parallel to the workpiece axis of rotation 1.1 (see upper image on FIG. 6). In addition, the brake disk 1 and the grinding wheels 2*a*, 2*b* are angulated to each other in a horizontal direction in such a way that the brake disk is located at the height between the two grinding wheels 2*a*, 2*b*.

In the following (see upper and middle image on FIG. 6), the brake disk 1 and the grinding wheels 2*a*, 2*b* are moved toward each other in a horizontal direction in such a way that the angulated grinding wheels 2*a*, 2*b* each come into contact with a workpiece surface of the hard-coated brake disk 1 to be processed, and process the workpiece surfaces. The linear motion that takes place along the arrows 8*a* can also be referred to as a peeling motion. During the processing operation, then, both the brake disk 1 and the grinding wheels 2*a*, 2*b* are driven around their respective axes of rotation, and each grinding wheel 2*a*, 2*b* is in contact with the workpiece surfaces to be processed by it. The angulation of the grinding wheels 2*a*, 2*b* to the brake disk 1 reduces the contact surface between the respective grinding wheel 2*a*, 2*b* and the accompanying workpiece surfaces (vis-à-vis a parallel angulation), so that a higher pressure is present between the grinding wheel 2*a*, 2*b* and brake disk 1 in the contact zone at an identical external force. As a consequence, the brake disk 1 can be processed with a high ablation rate at reduced process forces.

At the end of the peeling motion 8*a*, a piercing motion can take place along the arrows 8*b*, during which the grinding wheels 2*a*, 2*b* are moved toward the brake disk 1 parallel to the workpiece axis of rotation 1.1. In order to further improve the surface quality (dimensional accuracy, roughness) of the brake disk 1, the grinding wheel axes of rotation 2*a*.1, 2*b*.1 are initially aligned parallel to the workpiece axis 1.1 by a swiveling motion (denoted by arrows 8*c*) (see middle image on FIG. 6). In an additional processing step (see lower image on FIG. 6), a classic plan processing of the brake disk 1 takes places, during which the workpiece surface of the brake disk 1 to be processed and the end faces of the grinding wheels 2*a*, 2*b* used for processing are aligned parallel to each other. In order to correct a change in process force caused by the ablation, the brake disks 2*a*, 2*b* can be moved toward the brake disk 1 parallel to the workpiece axis of rotation 1.1 along the arrows 8*d* during this last processing step.

As may also be discerned from FIG. 5, both the first conditioning device 7*a* for dressing the grinding wheels 2*a*, 2*b* and the second conditioning device 7*b* for sharpening the grinding wheels 2*a*, 2*b* are brought to a conditioning position in which the conditioning devices 7*a* and 7*b* abut against one of the grinding wheels 2*a*, 2*b*, while the brake disk 1 is being processed with the grinding wheels 2*a*, 2*b*. The grinding wheels 2*a*, 2*b* are thus conditioned during the processing operation.

REFERENCE LIST

1 Workpiece
1.1 Workpiece axis of rotation
2*a* First grinding wheel
2*a*.1 First grinding wheel axis of rotation
2*b* Second grinding wheel
2*b*.1 Second grinding wheel axis of rotation
3 Workpiece driving device
4*a* First grinding wheel driving device
4*b* Second grinding wheel driving device
5 Infeed device
6*a* First angulating device
6*a*.1 First swivel axis
6*a*.2 Second swivel axis
6*a*.1*i* First angulating drive
6*a*.2*i* First angulating drive
6*a*.3 Inner bearing sleeve
6*a*.4 Second bearing sleeve
6*a*.5 Outer sleeve
6*b* Second angulating device
7*a* First conditioning device
7*b* Second conditioning device
8*a* Peeling motion
8*b* Piercing motion
8*c* Aligning motion
8*d* Corrective motion

The invention claimed is:

1. A method for processing a hard-coated and planar workpiece surface of a rotationally disk-shaped symmetrical workpiece (1) with at least one grinding wheel, comprising the following steps:

driving the workpiece (1) into a rotational motion around a workpiece axis of rotation (1.1), driving a grinding wheel (2*a*) into a rotational motion around a grinding wheel axis of rotation (2*a*.1), angulating the grinding wheel axis of rotation (2*a*.1) and the workpiece axis of rotation (1.1) to each other so that the grinding wheel axis of rotation (2*a*.1) and the workpiece axis of rotation (1.1) are not parallel, processing the workpiece surface with the grinding wheel (2*a*), wherein the grinding wheel (2*a*) is in contact with the workpiece surface, wherein an angle of incidence between the grinding wheel axis of rotation (2*a*.1) and the workpiece axis of rotation (1.1) is changed during the processing step while the workpiece surface is in contact with the grinding wheel.

2. The method according to claim 1, wherein the grinding wheel (2*a*) and the workpiece (1) are moved relative to each other in a plane perpendicular to the workpiece axis of rotation (1.1) during the processing step.

3. The method according to claim 1, wherein a second hard-coated and planar workpiece surface of the rotationally symmetrical workpiece (1) is processed with a second grinding wheel (2*b*) that rotates around a second grinding wheel axis of rotation (2*b*.1), wherein the second grinding wheel axis of rotation (2*b*.1) is angulated to the workpiece axis of rotation (1.1) in such a way that the workpiece axis of rotation (1.1) and the second grinding wheel axis of rotation (2*b*.1) are not parallel.

4. The method according to claim 3, wherein an angle of incidence between the second grinding wheel axis of rotation (2*b*.1) and the workpiece axis of rotation (1.1) is changed during the processing step while the second workpiece surface is in contact with the second grinding wheel.

5. The method according to claim 1, wherein the grinding wheel (2*a*) is dressed and/or sharpened during the processing step.

6. The method according to claim 1, wherein the workpiece axis of rotation (1.1) and the grinding wheel axis of rotation (2*a*.1) are aligned parallel to each other in a subsequent processing step.

7. The method according to claim 1, wherein the workpiece axis of rotation (1.1) or the grinding wheel axis of rotation (2*a*.1) can be swiveled around one rotational degree of freedom or around two rotational degrees of freedom for angulation purposes.

8. The method according to claim 1, wherein at least the following steps are performed in the indicated sequence:

i) angulating grinding wheel axes of rotation (2*a*.1, 2*b*.1) of two grinding wheels (2*a*, 2*b*) to the workpiece axis of rotation (1.1), ii) relatively moving the workpiece to the angulated grinding wheels (2*a*, 2*b*) during a first processing step, iii) aligning grinding wheel axes of rotation (2*a*.1, 2*b*.1) to the workpiece axis of rotation (1.1), so that the grinding wheel axes of rotation (2*a*.1, 2*b.a*) and the workpiece axis of rotation (1.1) are parallel, iv) processing the workpiece in a second processing step, during which the grinding wheel axes of rotation (2*a*.1, 2*b.a*) and the workpiece axis of rotation (1.1) are parallel.

9. A device for processing a hard-coated and planar workpiece surface of a rotationally disk-shaped symmetrical workpiece (1), comprising:

a workpiece driving device (3) for generating a rotational motion around a workpiece axis of rotation (1.1), at least one grinding wheel driving device (4*a*, 4*b*) for generating a rotational motion around at least one grinding wheel axis of rotation (2*a*.1, 2*b*.1) of at least one grinding wheel (2*a*, 2*b*), at least one infeed device (5) for bringing the at least one grinding wheel (2*a*, 2*b*) into contact with the workpiece surface, and at least one angulating device (6*a*, 6*b*) for angulating the at least one grinding wheel axis of rotation (2*a*.1, 2*b*.1) and the workpiece axis of rotation (1.1) to each other, so that the at least one grinding wheel axis of rotation (2*a*.1, 2*b*.1) and the workpiece axis of rotation (1.1) are not parallel, and a controller configured to change an angle of incidence between the grinding wheel axis of rotation (2*a*.1) and the workpiece axis of rotation (1.1) during a processing operation while the workpiece surface is in contact with the grinding wheel.

10. The device according to claim 9, wherein the at least one infeed device (5) is set up in such a way that the at least one grinding wheel (2*a*, 2*b*) and the workpiece (1) can be moved relative to each other during the processing operation in a plane perpendicular to the workpiece axis of rotation (1.1).

11. The device according to claim 9, further comprising a second grinding wheel driving device (4*b*) for generating a rotational motion around a second grinding wheel axis of rotation (2*b*.1) and a second angulating device (6*b*) for angulating the second grinding wheel axis of rotation (2*b*.1) to the workpiece axis of rotation (1.1), so that the second grinding wheel axis of rotation (2*b*.1) and the workpiece axis of rotation (1.1) are not parallel.

12. The device according to claim 9, comprising at least one conditioning device (7), which can be brought from an initial position into a conditioning position, so that the at least one grinding wheel (2*a*, 2*b*) can be conditioned during the processing operation.

13. The device according to claim 9, wherein the at least one angulating device (6*a*, 6*b*) is designed in such a way that the workpiece axis of rotation (1.1) or the at least one grinding wheel axis of rotation (2*a*.1, 2*b*.1) can be swiveled by exactly one rotational degree of freedom or by several rotational degrees of freedom.

14. The device according to claim 9, wherein the controller is set up to implement the following steps:

driving the workpiece into the rotational motion around the workpiece axis of rotation, driving the at least one grinding wheel into the rotational motion around the at least one grinding wheel axis of rotation, angulating the at least one grinding wheel axis of rotation and the workpiece axis of rotation to each other so that the at least one grinding wheel axis of rotation and the workpiece axis of rotation are not parallel, processing the workpiece surface with the at least one grinding wheel, wherein the at least one grinding wheel is in contact with the workpiece surface.

* * * * *